US009190792B2

(12) United States Patent
Dreisewerd et al.

(10) Patent No.: US 9,190,792 B2
(45) Date of Patent: Nov. 17, 2015

(54) RECESSED HINGE WITH ELECTRICAL CONNECTION

(71) Applicants: Nicholas Dreisewerd, Rietberg (DE); Nicholas Liermann, Rheda-Wiedenbrueck (DE); Reinhard Wolf, Rheda-Wiedenbrueck (DE)

(72) Inventors: Nicholas Dreisewerd, Rietberg (DE); Nicholas Liermann, Rheda-Wiedenbrueck (DE); Reinhard Wolf, Rheda-Wiedenbrueck (DE)

(73) Assignee: SIMONSWEK GMBH, Rheda-Wiedenbruck (DE)

( * ) Notice: Subject to any disclaimer, the term of this patent is extended or adjusted under 35 U.S.C. 154(b) by 0 days.

(21) Appl. No.: 14/341,810

(22) Filed: Jul. 27, 2014

(65) Prior Publication Data

US 2015/0031224 A1 Jan. 29, 2015

(30) Foreign Application Priority Data

Jul. 29, 2013 (DE) ..... 10 2013 108 083

(51) Int. Cl.

| | |
|---|---|
| ***H01R 35/04*** | (2006.01) |
| ***H01R 35/02*** | (2006.01) |
| ***E05D 3/18*** | (2006.01) |
| ***E05D 11/00*** | (2006.01) |
| ***E05D 7/00*** | (2006.01) |

(52) U.S. Cl.

CPC ..... *H01R 35/04* (2013.01); *E05D 3/186* (2013.01); *E05D 7/00* (2013.01); *E05D 11/0081* (2013.01); *E05Y 2600/41* (2013.01); *E05Y 2900/132* (2013.01)

(58) Field of Classification Search

CPC ..... H01R 35/04; H01R 35/02; G06F 1/1683; E05D 11/0081; E05D 15/165

See application file for complete search history.

(56) References Cited

U.S. PATENT DOCUMENTS

| | | | | |
|---|---|---|---|---|
| 5,681,176 | A * | 10/1997 | Ibaraki et al. | 439/165 |
| 5,995,373 | A * | 11/1999 | Nagai | 361/755 |
| 6,829,808 | B2 * | 12/2004 | Neukotter | 16/366 |
| 7,824,200 | B2 * | 11/2010 | Bryla et al. | 439/165 |
| 8,517,747 | B2 * | 8/2013 | Bryla et al. | 439/165 |
| 2007/0032275 | A1 * | 2/2007 | Suzuki et al. | 455/575.3 |
| 2008/0141488 | A1 * | 6/2008 | Leach | 16/223 |
| 2011/0026204 | A1 | 2/2011 | Yang | |

FOREIGN PATENT DOCUMENTS

DE 102007041816 A 3/2009

* cited by examiner

*Primary Examiner* — Gary Paumen
(74) *Attorney, Agent, or Firm* — Andrew Wilford

(57) ABSTRACT

A hinge for recessed installation between a door frame and a door panel has two housings adapted for recessing in the door frame and an edge of the door panel, a link assembly extending between and pivotally interconnecting the two housings, and a multiconductor cable extending between the housings and having opposite ends each in a respective one of the housings. Respective connectors on the ends of the cable are fixed in the housings.

7 Claims, 3 Drawing Sheets

RECESSED HINGE WITH ELECTRICAL CONNECTION

FIELD OF THE INVENTION

The present invention relates to a recessed hinge. More particularly this invention concerns such a hinge through which an electrical connection is made between the door frame and the door panel.

BACKGROUND OF THE INVENTION

As described in U.S. Pat. No. 6,829,808, which is herewith incorporated by reference, a known door hinge for recessed installation between an edge of a door panel and a door jamb has first and second housings that each form a cavity and are recessed in the door-panel edge and in the door jamb. A pair of U-section links pivoted centrally together about a center axis each have a first end and a second end engaged in the cavities of the respective first and second housings. The first end of one of the links and the second end of the other link are pivoted about respective vertical axes fixed in the respective housings and the second end of the one link and the first end of the other link are pivotal about another respective vertical axis and horizontally shiftable in a respective guide of the respective housings. Thus when the assemblies are fitted to respective mortises in the jamb and door edge, when the door is closed the hinge is not visible.

By providing an electrical connection assembly extending between the two housings, such hinges fasten doors not only invisibly on a door frame but also can be set up to connect electrical loads and sensors on them without a visible cable. Possible areas of use are, for example, electrical door locks, alarm systems, access monitoring systems, illumination devices and fire alarm systems.

A hinge with the above-described features is known from DE 10 2007 041 816. In this known hinge a ribbon cable extends through between the links of the link assembly and exits through holes on the back walls of the housings.

In a hinge known from US 2001/0026204 a flexible electrical connection assembly is provided that comprises electrical connectors on both ends. The connectors are connected to each other by a cable.

The known measures are expensive to assemble. Furthermore, the cable that runs through the link assembly can be damaged by uncontrolled intrinsic movements during actuation of the hinge.

This represents a serious danger for the functionality of the attached devices.

OBJECTS OF THE INVENTION

It is therefore an object of the present invention to provide an improved recessed hinge with electrical connection.

Another object is the provision of such an improved recessed hinge with electrical connection that overcomes the above-given disadvantages, in particular that reduces the risk of damage to the electrical connection.

SUMMARY OF THE INVENTION

A hinge for recessed installation between a door frame and a door panel has according to the invention two housings adapted for recessing in the door frame and an edge of the door panel, a link assembly extending between and pivotally interconnecting the two housings, and a multiconductor cable extending between the housings and having opposite ends each in a respective one of the housings. Respective connectors on the ends of the cable are fixed in the housings.

The electrical connectors can be designed as standard commercial plugs or sockets. The design in accordance with the invention has several advantages: On the one hand the connection can be separately produced or purchased as a prefabricated cable with two plug connectors on its ends. Connecting to the individual wires of the cable is eliminated by the assembly of the hinges as well as by incorporation of the hinge into the door frame and the door panel. There is also a simplification in the subsequent installation since electrical lines on the door panel and on the door frame can be detachably electrically connected in a particularly simple manner and in particular also reconnected in a detachable, electrical manner. A further fastening of the multiconductor cable is not necessary on account of the secure fixing of the connectors.

In a preferred embodiment of the invention the connectors are fixed in holes in back walls of the respective housings.

The housings of the recessed hinge are box-shaped inserts whose open front sides in the closed state of the door confront each other. The back area therefore is those surfaces of the boxes that are the farthest apart from each other in the closed door state. The appropriate arrangement of the electrical connection makes possible cable guidance that is only insignificantly disturbed by the mechanism of the link assembly. Furthermore, an especially advantageous further guidance of the electrical line in the plane of the door panel is possible.

The multiconductor cable is advantageously constructed as a ribbon cable. A ribbon cable has the advantage that it is designed to be especially flexible in one direction, whereas it is stiffer in a direction perpendicular to its longitudinal extent. This is advantageous for the intended use since a ribbon cable can follow the pivoting movement of the hinge especially well and it has less of a tendency to sag. A sagging cable could get pinched between individual links and be damaged as a result. Nevertheless, the use of round cables and other flexible cables is possible according to the invention.

In one embodiment at least one connector is permanently connected by a foam and/or a cast mass to the respective housing. To this end, for example, polyurethane-based plastic foams, artificial resins or thermoplastic plastics can be considered. If necessary, sealing agents must be provided in order to prevent an overflow of the materials.

In another embodiment of the invention at least one connector is positively fixed by a holder to the respective housing. The holder constitutes the positive closure between the connector and the receiving element. Such a holder can be used, for example, to fasten a commercial plug or a commercial socket to the given geometry of the hinge. It is also possible, depending on the need, to fasten different cables or, as a consequence thereof, different connectors with correspondingly designed holders on the same housing of a hinge. Therefore, the individual requirements of the customer can be especially addressed while the base body of the hinge does not have to be changed. Adaptations for other line types such as, for example glass-fiber cables, water lines or compressed-air lines are also conceivable.

In an advantageous embodiment of the invention the holder surrounds the respective connector in a positive manner and is fastened by a catch formation to the respective housing. The positive closure between the holder and the connector is produced in that the holder has at least partially a negative profile complementary to the outer surface shape of the connector. The holder is appropriately held by the catch formation in such a manner on the respective housing that the contact can no longer leave the positive closure with the holder. Alternatively, the holder can also be constructed in such a manner that another catch formation results between the connector and the holder that secures the positive closure of the two parts.

In an especially preferred embodiment the holder comprises a multipart structural element having two shells that positively surround the respective connector and are fixed by a catch formation in a hole of the respective housing. The edge of the hole holds the shells in a positive manner on the connector. According to this embodiment an especially simple assembly can be realized. For the assembly the connector is first placed between the shells of the holder. The shells can at first make contact only loosely, which simplifies in particular the disassembly. Subsequently, the holder is fixed by a catch formation in a respective hole of the housing. The catch formation turns out to be especially advantageous since no other tool is required. However, even other fastening methods such as, for example, screw fasteners are comprised by the invention. The parts of the holder are held together in such a manner by the edges of the hole that the positive closure with the connector is ensured. Therefore, a reliable, indirect positive closure is established between the housing and the connector. Depending on the design, an especially effective transfer of force can be ensured by large contact surfaces. Furthermore, the holder can also assume a protective function for the surrounded connector and possibly surrounded parts of the cable.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
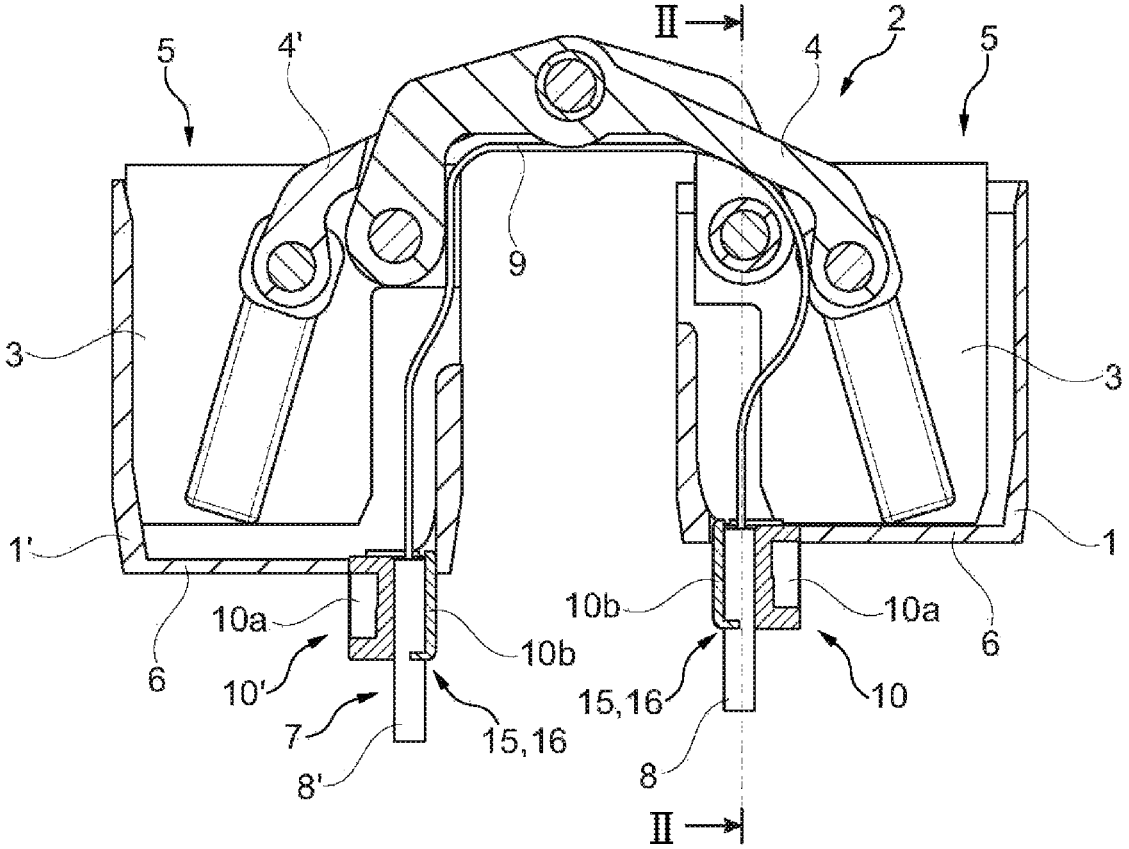
FIG. 1 is a horizontal section through a hinge in accordance with the invention.

As seen in FIG. 1 a hinge according to the invention comprises two substantially identical housings 1 and 1' interconnected by a link assembly 2 and intended for recessing in a door frame and in an edge of a door panel. The link assembly 2 comprises a known design for a recessed hinge, and comprises two links 4 and 4' that are pivoted on one another and rotatably supported on guides 3. Furthermore, the links 4 and 4' are pivotably and movably guided in a connecting link guide of the guides 3. The guides 3 are fixed to the housings 1 and 1'. Other constructive embodiments, in particular multipivot systems, are also possible.

The housings 1 and 1' are formed as parallepipedal metallic boxes and have open front sides 5 that confront each other when the hinge is closed, that is, in the unillustrated closed state of the door. The front sides 5 form openings through which the links 4 and 4' extend. FIG. 1 shows the open position in which the front sides 5 are parallel to one another and open in the same direction. The housings 1 and 1' have back walls 6 that are opposite the front sides 5.

The hinge furthermore comprises a flexible electrical connection 7. It is formed by a flexible ribbon cable 9 whose opposite ends carry connectors 8 and 8' in turn constituted by standard ribbon-cable. These connectors 8 and 8' are fixed to the housings 1 and 1' by holders 10 and 10', with a mass 17 of foam or adhesive ensuring a permanent connection.

Figure 2:
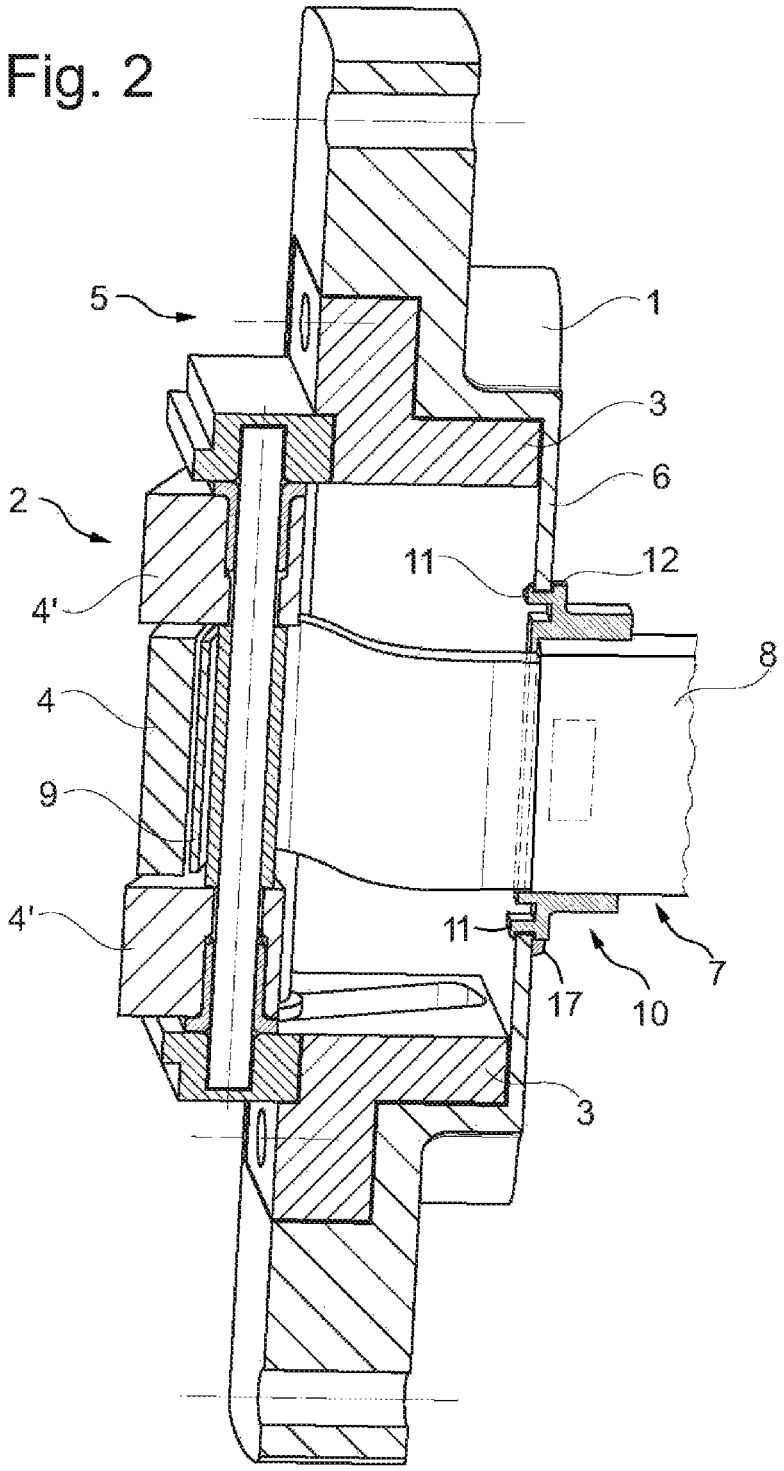
FIG. 2 is a perspective section through a hinge in accordance with the invention in the section plane II-II in FIG. 1.

FIG. 2 shows that each of the holders 10 is held by catch formations constituted by barb ends of clip arms 11 in a respective hole in the back wall 6 of the respective housing 1 or 1'. As shown in FIG. 2, a flange 12 prevents it from being pushed in further by engaging a flat ack face of the housing 1 or 1'. In the assembled state shown in FIG. 2, only the plug 8 projects at the back wall 6 of the housing 1 from the electrical connection 7. The multiconductor ribbon cable 9 is wholly contained in and between the housings so that it is protected from damage inside the hinge. When the hinge is open it is shielded from the outside by the links 4 against which it rests on the inside.

Figure 3:
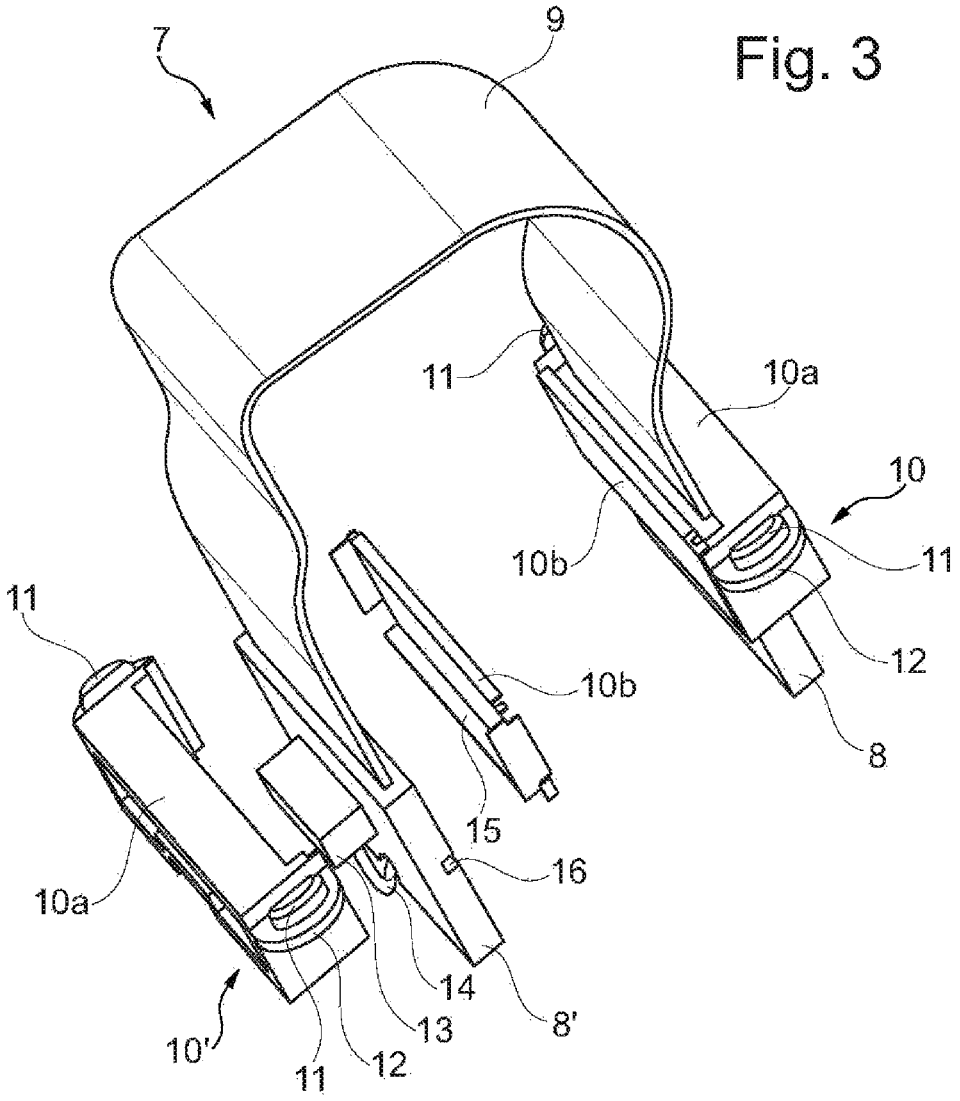
FIG. 3 is a perspective view of the electrical connection in a hinge of the invention with a mounted holder as well as a not yet mounted holder in an exploded view.

FIG. 3 shows how the two holders 10 and 10' each consist of two shells 10*a* and 10*b* that positively surround the respective plug 8 or 8' and that can be clipped together around a respective one of the plugs 8 or 8'. When the shells 10*a* and 10*b* are fitted together, the plug 8 or 8' is locked in place and cannot slide out. The positive mounting is produced in that a lateral projection 13 on the plug 8 fits into a respective recess of the shell 10*a*. A barb-end safety hook 14 for securing a connector 8 to another connector (plug or jack) outside the respective housing 1 or 1' can project past the back wall 6 from the holder 10. The opposite shell 10*b* engages with a bent edge 15 into a groove 16 of the respective plug 8.

We claim:

1. A hinge for recessed installation between a door frame and a door panel, the hinge comprising:

two housings adapted for recessing in the door frame and an edge of the door panel;

a link assembly extending between and pivotally interconnecting the two housings;

a multiconductor cable extending between the housings and having opposite ends each in a respective one of the housings; and respective connectors on the ends of the cable and fixed in the housings.

2. The recessed hinge defined in claim 1, wherein each of the housings has a back wall formed with a throughgoing hole in which the respective connector is fixed.

3. The recessed hinge defined in claim 1, wherein the multiconductor cable is a ribbon cable.

4. The recessed hinge defined in claim 1, further comprising:

a foam or cast mass connecting at least one of the connectors to the respective housing.

5. The recessed hinge defined in claim 1, wherein each of the housings has a back wall formed with a throughgoing hole, the hinge further comprising:

respective holders fitting in each of the holes and fitted around and securing the respective connector therein.

6. The recessed hinge defined in claim 5, wherein each of the holders has a catch formation securing it to the respective back wall.

7. The recessed hinge defined in claim 5, wherein each of the holders is formed by two shells that fit together and grip the respective connector.

* * * * *